United States Patent [19]

Hirano et al.

[11] Patent Number: 4,813,326

[45] Date of Patent: Mar. 21, 1989

[54] METHOD AND APPARATUS FOR SYNTHESIZING MUSIC TONES WITH HIGH HARMONIC CONTENT

[75] Inventors: Hiroshi Hirano, Higashihiroshima; Kazuhisa Okamura, Hamamatsu, both of Japan

[73] Assignee: Yamaha Corporation, Hamamatsu, Japan

[21] Appl. No.: 87,997

[22] Filed: Aug. 18, 1987

Related U.S. Application Data

[63] Continuation of Ser. No. 755,188, Jul. 15, 1985, abandoned.

[30] Foreign Application Priority Data

Jul. 16, 1984 [JP] Japan ..... 59-146039
Aug. 7, 1984 [JP] Japan ..... 59-164227
Aug. 9, 1984 [JP] Japan ..... 59-165574

[51] Int. Cl.[4] ..... G10H 1/14; G10H 7/00

[52] U.S. Cl. ..... 84/1.01; 84/1.22; 84/1.24

[58] Field of Search ..... 84/1.01, 1.19–1.24, 84/DIG. 10

[56] References Cited

U.S. PATENT DOCUMENTS 3,699,233 10/1972 Suzuki ..... 84/1.22
4,018,121 4/1977 Chowning ..... 84/1.01
4,253,367 3/1981 Hiyoshi et al. ..... 84/1.22
4,256,004 3/1981 Takeuchi ..... 84/1.21
4,422,362 12/1983 Chibana ..... 84/1.19
4,453,441 6/1984 Deutsch ..... 84/1.22
4,485,717 12/1984 Kitagawa ..... 84/1.22
4,569,268 2/1986 Futamase et al. ..... 84/1.24

FOREIGN PATENT DOCUMENTS 7570 4/1979 Japan .
29519 6/1983 Japan .

*Primary Examiner*—Stanley J. Witkowski
*Attorney, Agent, or Firm*—Spensley Horn Jubas & Lubitz

[57] ABSTRACT

A musical tone signal is synthesized on the basis of a predetermined modulation operation (e.g. an FM or AM operation) employing a modulating signal and a carrier signal respectively having an audio range frequency. The modulating wave signal and/or carrier signal is derived by reading out a predetermined waveshape signal from a waveshape table in accordance with progressive phase angle data. The value of the waveshape signal read out from the waveshape table is modified in a specified phase section. This modification is effected by applying a simple operation such as gating, shifting or selecting to the phase angle data addressing the waveshape table or to the waveshape signal read out from the waveshape table. The modified waveshape signal is utilized in a predetermined modulation operation as the modulating wave signal and/or carrier signal. The frequency component of the modulating signal and/or carrier signal is controlled by the waveshape modification whereby synthesis of a musical tone having abundant frequency components is realized with a simple circuit construction.

21 Claims, 8 Drawing Sheets

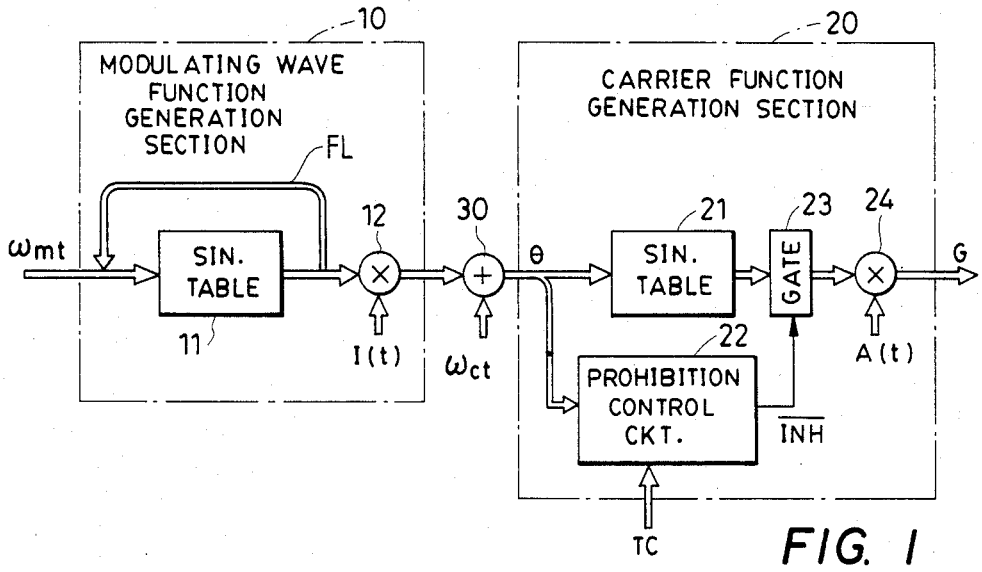
FIG. 1
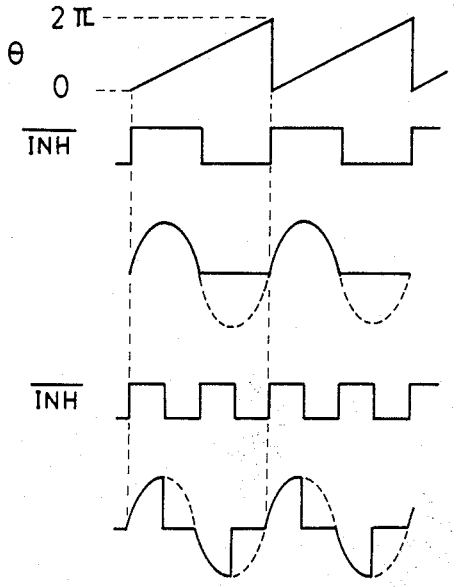
FIG. 2a
FIG. 2b
FIG. 2c
FIG. 2d
FIG. 2e
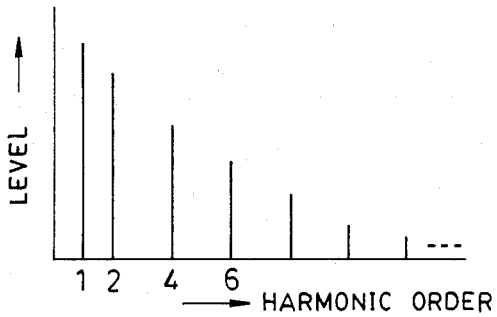
FIG. 3

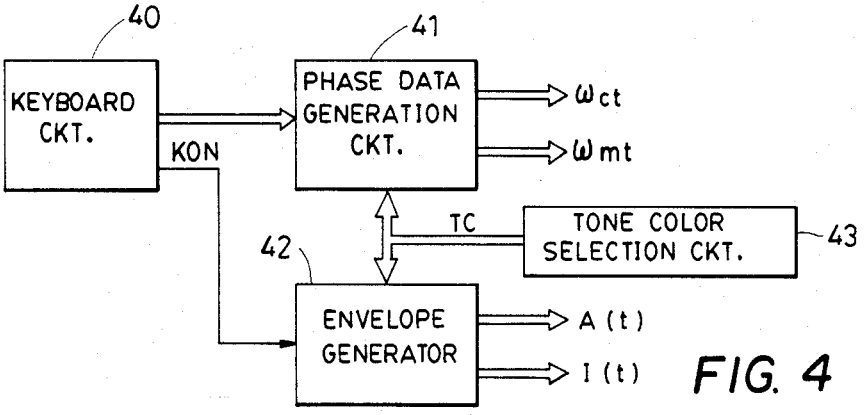
FIG. 4
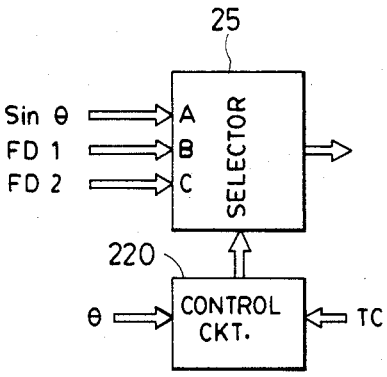
FIG. 5
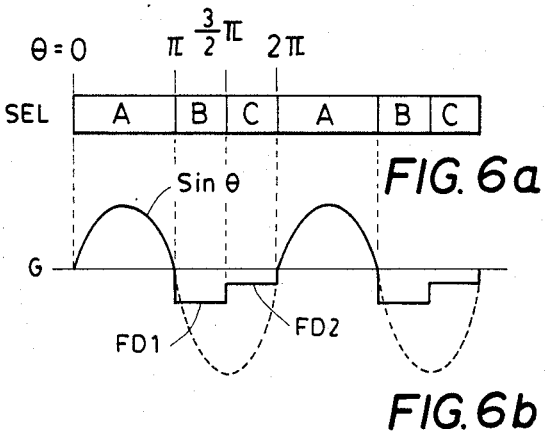
FIG. 6a
FIG. 6b
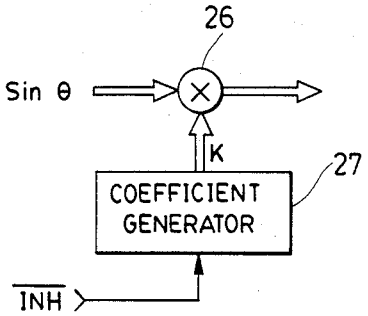
FIG. 7
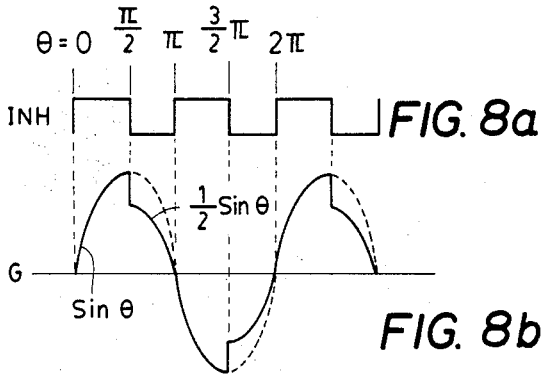
FIG. 8a
FIG. 8b

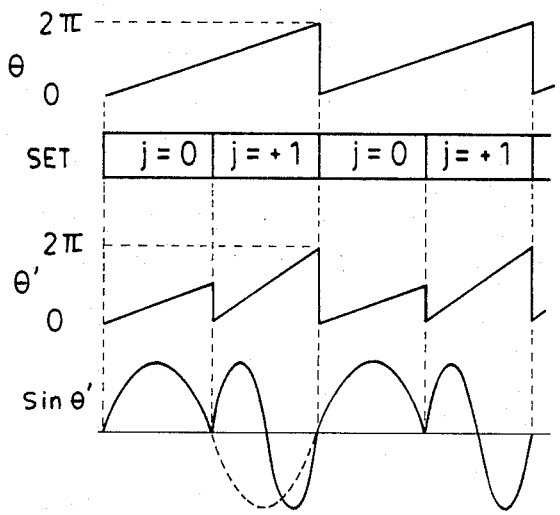
FIG. 12a
FIG. 12b
FIG. 12c
FIG. 12d
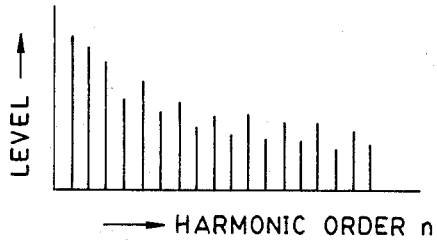
FIG. 13
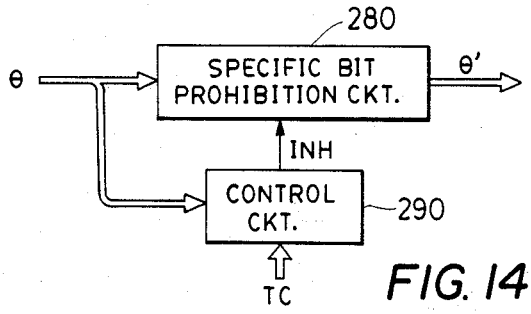
FIG. 14
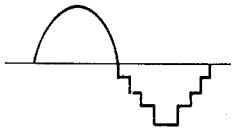
FIG. 15
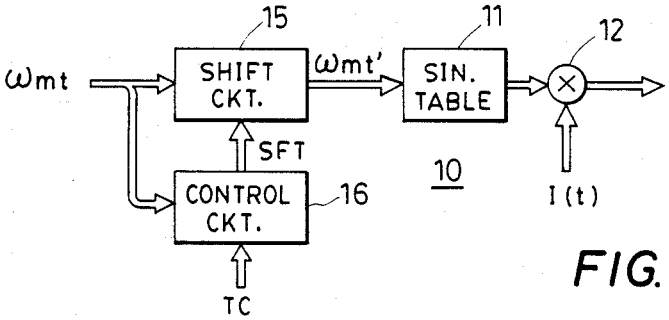
FIG. 16

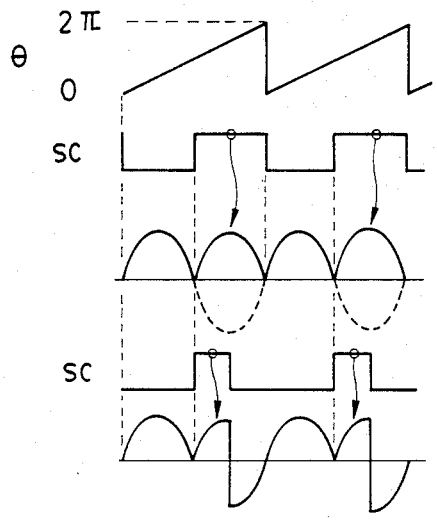
FIG. 19a
FIG. 19b
FIG. 19c
FIG. 19d
FIG. 19e
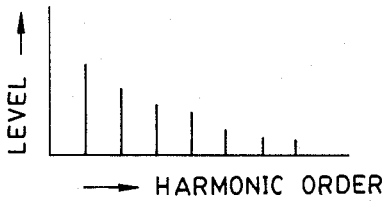
FIG. 20
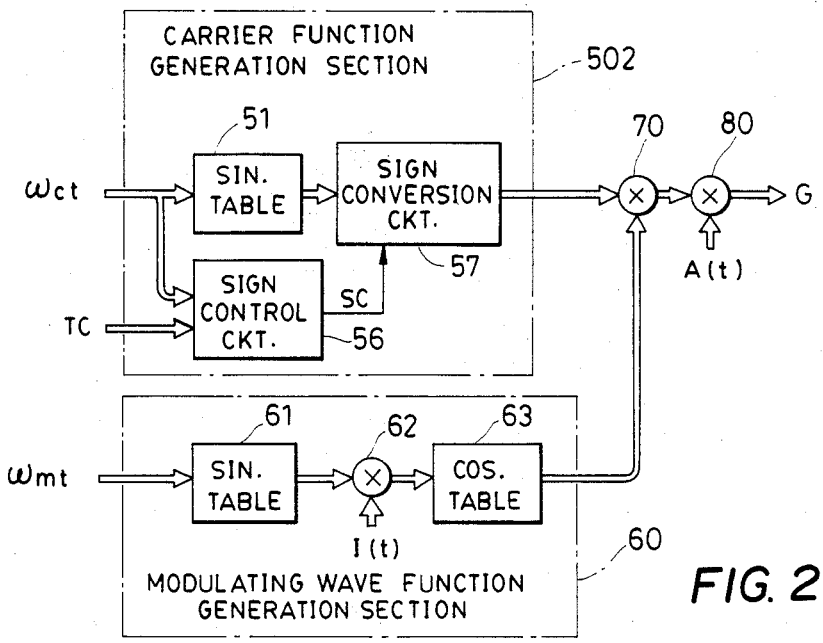
FIG. 21

METHOD AND APPARATUS FOR SYNTHESIZING MUSIC TONES WITH HIGH HARMONIC CONTENT

This is a continuation of copending application Ser. No. 755,188 filed on July 15, 1985 and now abandoned.

BACKGROUND OF THE INVENTION

This invention relates to a method for synthesizing musical tones by using a modulation operation such as a frequency modulation operation or an amplitude modulation operation and, more particularly, to a method for synthesizing musical tones capable of controlling a complicated waveshape by a simple operation.

A basic system for generating a tone signal having desired overtone composition by using a frequency modulation (hereinafter abbreviated as FM) operation of an audio frequency range is disclosed in U.S. Pat. No. 4,018,121. A similar system generating a tone signal by performing a similar FM operation by using a waveshape containing abundant harmonic components (e.g., a saw tooth waveshape) is disclosed in Japanese Patent Publication No. 7570/1979 (corresponding to U.S. patent application, Ser. No. 922,883 filed on July 7, 1978, now U.S. Pat. No. 4,643,066. Further, a basic system for generating a tone signal having a desired overtone composition by using an amplitude modulation (hereinafter abbreviated as AM) of an audio frequency range is disclosed in Japanese Patent Publication No. 29519/1983 (corresponding to U.S. patent application Ser. No. 66,285 filed on Aug. 13, 1979, abandoned).

In the above described prior art systems, however, a simple monomial modulation operation is insufficient for synthesizing a satisfactory tone color having sufficient harmonic components and a complicated modulation operation of a multiplet or polynomial operation is required. This necessitates a complicated and large operation circuit and, in a system in which operation of each operation term is performed on a time shared basis, requires increase in the speed of the control clock with a resulting increase in the manufacturing cost. As a method for synthesizing a tone containing abundant harmonic components by a relatively simple operation, a method using a waveshape containing abundant frequency components as a modulating wave or carrier wave has been conceived as disclosed in the above mentioned Japanese Patent Publication No. 7570/1979. Since, however, the waveshape available for the operation is limited to the one or ones stored in the memory, tone colors which can be synthesized have been limited to a narrow range.

SUMMARY OF THE INVENTION

It is, therefore, an object of the invention to provide a method for synthesizing musical tones capable of controlling relatively large number of frequency components by a simple operation.

In a method for synthesizing a tone by a predetermined modulation operation using a modulating signal and a carrier signal, it is a first feature of the invention to change a value at a specified phase section of a function waveshape generated from a waveshape table to be used for generating a modulating wave function or a carrier function and utilize this changed function waveshape for the modulation operation. By changing a specified phase section of a function waveshape, this changed function waveshape is caused to contain abundant harmonic components so that a tone signal containing abundant harmonic components can be synthesized without performing a complicated operation such as a polynomial operation.

It is another feature of the invention to change phase data in its specified phase section for a waveshape table used for generating a modulating wave function or a carrier function and utilize a function waveshape generated from the waveshape table in response to this changed phase data for the modulation operation. By changing the phase data for the waveshape table in the specified phase section, the function waveshape generated from the waveshape table is changed in its waveshape in the specified phase section and this function waveshape itself is caused to contain abundant harmonic components. Accordingly, a tone signal containing abundant harmonic components can be synthesized without performing a complicated operation such as a polynomial operation.

It is a third feature of the invention to change the polarity at a specified phase section of a function waveshape generated from a waveshape table used for generating a modulating wave function or a carrier function and utilize this changed function waveshape for the modulation operation. By changing the polarity at the specified phase section of a function waveshape, the changed function waveshape is caused to contain abundant harmonic components so that a tone signal containing abundant harmonic components can be synthesized without performing a complicated modulation operation such as a polynomial operation.

Consequently, according to these features of the invention, the circuit design can be simplified with a resulting reduction in the manufacturing cost and a tone signal having various tone colors can be synthesized with a simple control.

BRIEF DESCRIPTION OF THE DRAWINGS

In the accompanying drawings,

FIG. 1 is a block diagram showing an embodiment of the invention in the tone synthesis system of the FM operation type;

FIGS. 2*a*–2*e* are diagrams showing an example each of output waveshapes in some portions in the circuit of FIG. 1;

FIG. 3 is a diagram of an example of frequency spectra of the waveshape of FIG. 2*c;*

FIG. 4 is a block diagram showing an example of a circuit for supplying various operation parameters used in the circuit of FIG. 1;

FIGS. 5 and 7 are block diagrams respectively showing modified examples of a portion for changing a carrier function waveshape in FIG. 1;

FIGS. 6*a* and 6*b* are waveshape diagrams for explaining an example of operation of the circuit of FIG. 5;

FIGS. 8*a* and 8*b* are waveshape diagrams for explaining an example of operation of the circuit of FIG. 7;

FIGS. 12*a*–12*d* diagrams showing an example each of output waveshapes of some portions in the circuit of FIG. 11;

FIG. 13 is a diagram showing an example of frequency spectra of the waveshape of FIG. 12*d;*

FIG. 14 is a block diagram showing a modified example of a portion for changing phase data in the embodiment of FIG. 11;

FIG. 15 is a diagram showing an example of a waveshape of a tone signal produced according to the modified example of FIG. 14;

FIG. 16 is a block diagram showing an embodiment in which the feature of the invention shown in FIG. 11 has been applied to the modulating wave function generation section;

FIGS. 19*a*–19*e* are diagrams showing an example each of output waveshapes of some portions in the circuit of FIG. 18;

FIG. 20 is a diagram showing frequency spectra of the waveshape of FIG. 19*c;*

FIG. 21 is a block diagram showing another embodiment of the invention in the tone synthesis system of the AM operation type;

DESCRIPTION OF PREFERRED EMBODIMENTS

Figure 9:
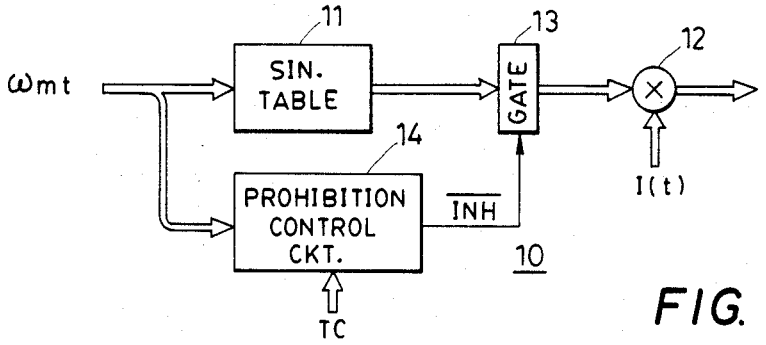
FIG. 9 is a block diagram showing an embodiment in which the feature of the invention shown in FIG. 1 has been applied to the modulating wave function generation section.

FIG. 1 is a block diagram showing an embodiment of the invention in the tone synthesis method of the FM operation type. This embodiment generally comprises a modulating wave function generation section 10, a carrier function generation section 20 and an adder 30 for performing phase modulation of the carrier. In the modulating wave function generation section 10, sinusoidal wave data sin $\omega mt$ is read out from a sinusoidal wave table 11 in response to modulating wave phase angle data $\omega mt$ and this read out data is multiplied with modulation index data I(t) by a multiplier 12 and the resulting data is provided as modulating wave data. In the adder 30, modulating wave data I(t) sin $\omega mt$ provided by the multiplier 12 is added to carrier phase angle data $\omega ct$ to perform the phase modulation of the carrier.

The carrier function generation section 20 generates a predetermined carrier function in accordance with phase angle data $\theta$ (i.e., $\theta=\omega ct+I(t)\cdot\sin \omega mt$) of the phase modulated carrier provided by the adder 30 and delivers out the phase-modulated signal as a tone signal G.

In the embodiment of FIG. 1, the present invention is applied to the carrier function generation section 20.

The carrier wave function generation section 20 comprises a sinusoidal wave table 21, a prohibition control circuit 22, a gate 23 and a multiplier 24. In the sinusoidal wave table 21, as phase angle data $\theta$ ($\theta=\omega ct+I(t)\cdot\sin \omega mt$) of the carrier is applied as an address signal from the adder 30, sinusoidal wave data sin $\theta$ is read out in response to this phase angle data $\theta$. This sinusoidal wave data sin $\theta$ is supplied to the gate 23.

The phase angle data $\theta$ is supplied also to the prohibition control circuit 22. This prohibition control circuit 22 produces a control signal $\overline{INH}$ which becomes "0" in a specified phase section in one period of the phase angle data $\theta$. The specified phase section in which the control signal $\overline{INH}$ becomes "0" is changed in response to a tone color selection signal TC. This control signal $\overline{INH}$ is applied to the gate 23. Thus, outputting of the sinusoidal wave data read out from the sinusoidal wave table 21 is prohibited while the control signal $\overline{INH}$ is "0".

For brevity of explanation, let us assume, by way of example, that the phase angle data 8 is data which increases linearly as shown in FIG. 2*a* ($\theta=\omega ct$), i.e., it is periodic data which has a regularly progressing for within each period. If the prohibition control circuit 22 produces the control signal $\overline{INH}$ as shown in FIG. 2*b* while the phase angle data $\theta$ changes from 0 to $2\pi$ in response to the tone color selection signal TC, waveshape data as shown in FIG. 2*c* in which the amplitude of the sine wave in the specified section is zero is provided from the gate 23. This waveshape shown in FIG. 2*c* has frequency spectra as shown in FIG. 3. In this way, the sinusoidal wave data which is changed in the specified section by the gate 23 is supplied to the multiplier 24 in which the control for setting the amplitude is effected by multiplying amplitude coefficient data A(t) and thereafter is delivered out as the tone signal G.

By way of another example, if the control signal $\overline{INH}$ produced by the prohibition control circuit 22 in response to the tone color selection signal TC assumes a waveshape as shown in FIG. 2*d,* waveshape data provided by the gate 23 assumes a waveshape as shown in FIG. 2*e.*

Thus, the tone signal G produced by the carrier function generation section 20 contains abundant harmonic components as will be apparent from the waveshapes shown in FIGS. 2*c* and 2*e.* As a result, the tone signal G containing abundant harmonic components can be obtained with a relatively simple construction.

The respective parameters $\omega mt$, I(t), $\omega ct$, TC and A(t) are supplied from a circuit as shown in FIG. 4. In FIG. 4, a keyboard circuit 40 detects a key being depressed in the keyboard of the electronic musical instrument and thereupon outputs key depression data. A phase data generation circuit 41 generates, in response to the key depression data supplied by the keyboard circuit 40, modulating wave phase angle data $\omega mt$ which changes at a period corresponding to the tone pitch of the depressed key and carrier phase angle data $\omega mt$.

An envelope generator 42 generates modulation index data I(t) sequentially changes timewise in response to a key-on signal KON which is generated upon depression of the key. The phase data generation circuit 41 and envelope generator 42 receive the tone color selection signal TC from a tone color selection circuit frequency ratio of the carrier phase angle data $\omega ct$ and the modulating wave phase angle data $\omega mt$ and waveshapes of time functions of the modulation index data I(t) and the amplitude coefficient data A(t) are controlled in accordance with the selected tone color.

In the embodiment of FIG. 1, the change of the sinusoidal wave data sin $\theta$ provided by the sinusoidal wave table 21 is effected by prohibiting outputting of the sinusoidal wave data sin $\theta$ in the specified section by the gate 23. Alternatively, this change may be made in the manner as shown in FIG. 5. In FIG. 5, the sinusoidal wave data sin $\theta$ and predetermined values FD1 and FD2 are applied to the selector 25 and these input signals are selected in accordance with a selection control signal SEL. The selection control signal SEL is generated by a control circuit 220 in response to phase angle data $\theta$. For example, in the control circuit 220, the selection control signal SEL is constructed in such a manner that, as shown in FIG. 6*a*, sin $\theta$ is selected in the section $\theta=0-\pi$ and the predetermined value FD1 is selected in the section $\theta=\pi-3/2\pi$ and the predetermined value FD2 is selected in the section $\theta=3/2\pi-2\pi$. By this arrangement, waveshape data of an even more complicated variation as shown in FIG. 6*b* can be obtained from the selector 25. Application of the construction of FIG. 5 to the embodiment of FIG. 1 can be made by replacing the gate 23 of FIG. 1 by the selector 25 of FIG. 5 and also replacing the prohibition control circuit 22 of FIG. 1 by the control circuit 220 of FIG. 5.

The change of the sinusoidal wave data may be made as shown in FIG. 7. In FIG. 7, the sinusoidal wave data $\theta$ is applied to the multiplier 26 and changed by a coefficient K supplied from a coefficient generator 27 to the multiplier 26 in response to the control signal $\overline{\text{INH}}$. For example, by generating coefficient K of K=0.5 by the coefficient generator 27 when the control signal $\overline{\text{INH}}$ is "0" and coefficient K=1.0 at each $\pi/2$ of the phase angle data $\theta$ when the control signal $\overline{\text{INH}}$ is "0" as shown in FIG. 8*a*, waveshape data of a waveshape which changes in a complicated manner as shown in FIG. 8*b* can be obtained from the multiplier 26. The application of the construction of FIG. 7 to the embodiment of FIG. 1 can be made by replacing the gate 23 of FIG. 1 by the multiplier 26 and coefficient generator 27 of FIG. 7.

The foregoing description has been made with respect to a case where this invention has been applied to the carrier function generation section 20. Alternatively, the invention may be applied to the modulating wave function generation section 10. More specifically, the modulating wave function generation section 10 is constructed as shown in FIG. 9, the sinusoidal wave data sin $\omega$mt generated by the sinusoidal wave table 11 in response to the modulating wave phase angle data $\omega$mt is applied to the gate 13 and the modulating wave phase angle data $\omega$mt is applied to the prohibition control circuit 14, the sinusoidal wave data sin $\omega$mt in the specified section is changed by the control signal $\overline{\text{INH}}$ provided by the prohibition control circuit 14 and the changed sinusoidal wave data sin $\omega$mt is multiplied by the modulation index data I(t) in the multiplier 12 whereby a modulating function containing abundant harmonic components is generated and the FM operation can be performed using this modulating wave function.

In this case, the invention may be concurrently applied both to the modulating wave function generation section 10 and the carrier function generation section 20. Further, if the output waveshape data of the sinusoidal wave, table 11 is fed back to the input side as shown by a line FL in FIG. 1 and the phase angle data $\omega$mt is modulated by this output waveshape data, a tone signal G provided with even more complicated harmonic components can be obtained.

Figure 10:
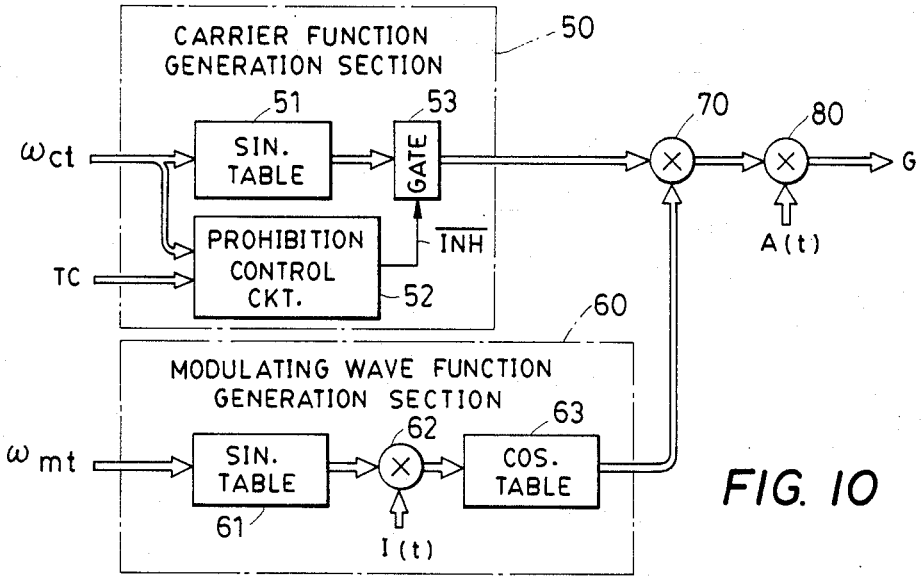
FIG. 10 is a block diagram showing an embodiment of the invention in the tone synthesis system of the AM operation type.

FIG. 10 is a block diagram showing an embodiment of the invention applied to the tone synthesis method of AM operation type. In this embodiment, the invention is applied to a carrier function generation section 50. The carrier function generation section 50 comprises a sinusoidal wave table 51, a prohibition control circuit 52 and a gate 53. Upon application of phase angle data $\omega$ct of the carrier to the sinusoidal wave table 51 as an address signal, sinusoidal wave data sin $\omega$ct corresponding to this phase angle data $\omega$ct is read out from this sinusoidal wave table 51 and supplied to the gate 53.

The phase angle data $\omega$ct is supplied to the prohibition control circuit 52 with the tone color selection signal TC. The prohibition control circuit 52 thereby generates a control signal $\overline{\text{INH}}$ which becomes "0" only in a specified section corresponding to the tone color selection signal TC in one period of the phase angle data $\omega$ct and supplies this control signal $\overline{\text{INH}}$ to the gate 53.

As a result, outputting of data of this specified section in the sinusoidal wave data sin $\omega$ct which is read out from the sinusoidal wave table 51 as the carrier function is prohibited so that a carrier function of a waveshape similar to the one shown in FIG. 2*c* or 2*e* is produced.

A modulating wave function generation section 60 which modulates this carrier function comprises a sinusoidal wave table 61, a multiplier 62 and a cosine wave table 63. Upon application of the modulating wave phase angle data $\omega$mt to the sinusoidal wave table 61 as an address signal, sinusoidal wave data sin $\omega$mt corresponding to the phase angle data $\omega$mt is read out from this sinusoidal wave table 61. This sinusoidal wave data sin $\omega$mt is multiplied with modulation index data I(t) in the multiplier 62 and thereafter is supplied to the cosine wave table 63 as an address signal. This causes cosine wave data cos{I(t)·sin $\omega$mt} to be read out from the cosine wave table 63. This cosine wave data cos {I(t)·sin $\omega$mt} is supplied to a multiplier 70 as the modulating wave function and the amplitude modulation operation is effected by multiplying this cosine wave data with the carrier function. The output of this multiplier 70 is supplied to a multiplier 80 to be multiplied with the amplitude coefficient data A(t) for controlling setting of the amplitude and thereafter is delivered out as a tone signal G.

Accordingly, the carrier function contains abundant harmonic components in itself in this embodiment also so that the finally obtained tone signal G contains abundant harmonic components.

In this embodiment also, the portion including the prohibition control circuit 52 and the gate 53 for changing the carrier function may be replaced by a construction similar to the one shown in FIGS. 5 or 7 in which case a tone signal containing more abundant harmonic components can be produced. The invention is applicable either to the modulating wave function generation section 60 only or to both the carrier function generation section 50 and the modulating wave function generation section 60.

In the embodiments of FIGS. 1, 9 and 10, modification may be made so that the gates 23, 13 and 53 are provided on the input side of the sinusoidal wave table thereby to control input data $\theta$, $\omega$mt and $\omega$ct by the control signal $\overline{\text{INH}}$. Further, if output data of the sinusoidal wave table 21, 11 or 51 is applied to the prohibition control circuit 22, 14 or 52 instead of applying the data $\theta$, $\omega$mt or $\omega$ct and the control signal $\overline{\text{INH}}$ is generated in response to the value of the output data of this sinusoidal wave table, a modulating wave function or carrier function in which a value below a predetermined level is removed can be obtained. In this case, if the input data of the prohibition control circuit 22, 14 or 52 is switched between the output data of the sinusoidal wave tables and the data $\theta$, $\omega mt$ and $\omega ct$, a modulating wave function or carrier function of even more complicated variations can be obtained.

The conditions of generation of the control signal $\overline{INH}$ generated by the prohibition control circuits 22, 14 and 52 may be sequentially changed with lapse of time from the start of generation of the tone.

Figure 11:
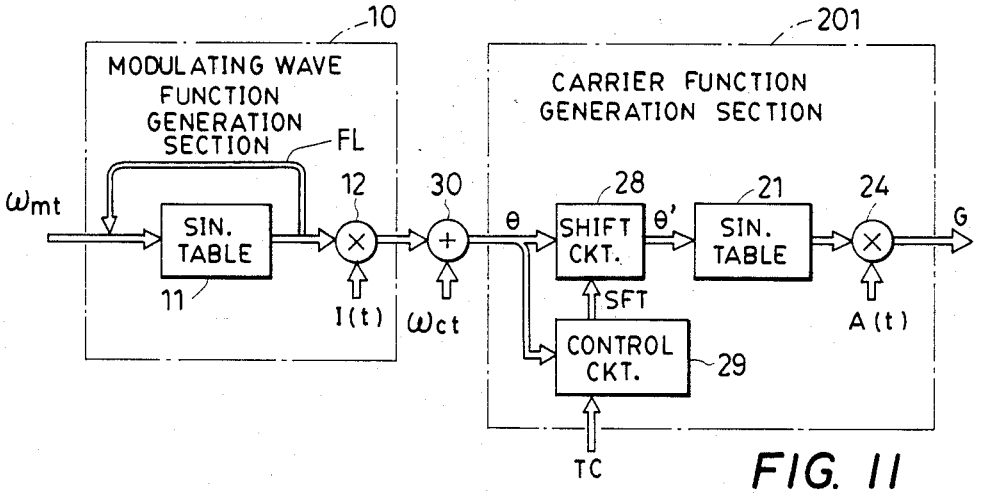
FIG. 11 is a block diagram showing another embodiment of the invention in the tone synthesis system of the FM operation type.

FIG. 11 shows another embodiment of the invention in the FM operation type tone synthesis device. This embodiment comprises, as in the embodiment of FIG. 1, a modulating wave function generation section 10, an adder 30 for phase modulation and a carrier function generation section 201. In the present embodiment, the invention is applied to the carrier function generation section 201.

The carrier function generation section 201 is composed of a shift circuit 28, a control circuit 29, a sinusoidal wave table 21 and a multiplier 24. Phase angle data $\theta$ of the carrier applied from the adder 30 is shifted to the more significant bit side or less significant bit side by a predetermined number of bits in the shift circuit 28. The direction and the amount of the shifting in this case is indicated by phase shift data SFT provided by the control circuit 29 and this phase shift data SFT is produced only in a specified section in one period of the phase angle data. The specified section in which the phase shift data SFT is produced is changed in accordance with the tone color selection signal TC. Accordingly, if the amount of shift to the more significant bit side is represented by $+j$ and that to the less significant bit side by $-j$, the phase angle data is multiplied by k (where $k=2^{\pm j}$) in the specified section in one period.

The phase angle data $\theta'$ which has been multiplied by k in the specified section is applied to the sinusoidal wave table 21 as an address signal. Upon the application of the phase angle data $\theta'$, sinusoidal wave data $\sin\theta'$ of a sinusoidal wave phase corresponding to this phase angle data $\theta'$ is read out from the sinusoidal wave table 21.

For brevity of explanation, let us assume that the phase angle data $\theta$ is linearly increasing data ($\theta=\omega ct$) as shown in FIG. 12*a*. If the control circuit 29 produces in response to the tone color selection signal TC phase shift data SFT of $j=0$, $j=+1$ as shown in FIG. 12*b* while the phase angle data $\theta$ changes from $\theta$ to $2\pi$, the shift circuit 28 produces phase angle data $\theta'$ obtained by shifting the original phase angle data $\theta$ by one bit to the more significant bit side, i.e., doubling it, as shown in FIG. 12*c* in the phase section $\pi-2\pi$. As a result, the sinusoidal wave table 21 produces sinusoidal wave data $\sin\theta'$ of one period as shown in FIG. 12*d* instead of the sinusoidal wave data of $\frac{1}{2}$ period shown by the dotted line in the phase section $\pi-2\pi$. In other words, in the specified phase section of one period of the original phase angle data $\theta$, the sinusoidal wave data $\sin\theta'$ of a different waveshape from that in the rest of the phase section is read out. In this manner, the sinusoidal wave data $\sin\theta'$ read out from the sinusoidal wave table 21 is supplied to the multiplier 24 in which the amplitude setting control is effected by multiplying the amplitude coefficient A(t) to provide the tone signal G. Since the waveshape of the sinusoidal wave data $\theta'$ read out from the sinusoidal wave table 21 is changed in the specified phase section as shown in FIG. 12*d*, the tone signal G contains abundant harmonic components so that it shows complicated frequency spectra as shown in FIG. 13. Accordingly, a tone signal containing abundant harmonic components can be obtained with a simple construction and without performing a complicated polynomial operation.

In the same manner as described previously, respective parameters $\omega mt$, I(t), $\omega ct$, TC and A(t) used in this embodiment may also be provided by a circuit such as shown in FIG. 4.

In the embodiment of FIG. 11, the change in the phase angle data $\theta$ is effected by shifting the phase angle data $\theta$ by a predetermined number of bit or bits to the more significant bit side or less significant bit side. Alternatively, the change in the phase angle data $\theta$ may be effected as shown in FIG. 14. In the example of FIG. 14, the shift circuit 28 is substituted by a specific bit prohibition circuit 280 and there is additionally provided a control circuit 290 which generates a control signal INH for prohibiting delivery of data of a specific bit or bits, e.g., less significant 3 bits, in the phase angle data $\theta$ applied to the specific bit prohibition circuit 280 during the specified phase section corresponding to the tone color selection signal TC. In the control circuit 290, the control signal INH is generated in the phase section of $\pi-2\pi$ in one period $0-2\pi$ of the phase angle data $\theta$ so that the less significant 3 bits of the phase angle data $\theta$ is forced to become "0" in the phase section $\pi-2\pi$. In this case, the sinusoidal wave data $\sin\theta'$ read out from the sinusoidal wave table 21 becomes a waveshape which changes progressively as shown in FIG. 15 in the phase section $\pi-2\pi$ and a tone signal G of a complicated waveshape thereby is produced.

The above is a case where the present invention has been applied to the carrier function generation section 210. Alternatively, the invention may be applied to the modulating wave function generation section 10. In this case, the modulating wave function generation section 10 may be constructed as shown in FIG. 16. In the construction of FIG. 16, modulating wave phase angle data $\omega mt$ is changed by shifting it by a predetermined number of bit or bits to the more significant bit side or less significant bit side in response to the phase shift data SFT produced by the control circuit 16 in response to the tone color selection signal TC and this changed modulating wave phase angle data $\omega mt'$ is applied to the sinusoidal wave table 11 as the address signal. As a result, a modulating wave function containing abundant harmonic components can be generated.

In this case, the shift circuit 15 and the control circuit 16 may be substituted by the constructions as shown in FIG. 14. The invention may be concurrently applied both to the modulating wave function generation section 10 and the carrier function generation section 201.

Further, if in FIG. 11 the output waveshape data of the sinusoidal wave table 11 is fed back to the input side thereof as shown by the line FL and the phase angle data $\omega mt$ is modulated by this output waveshape data, a tone signal G with even more complicated harmonic components can be produced. Further, the control signals SFT and INH may be changed in their condition of generation not only by the tone color selection signal TC but also by an envelope shape signal which changes with time.

Figure 17:
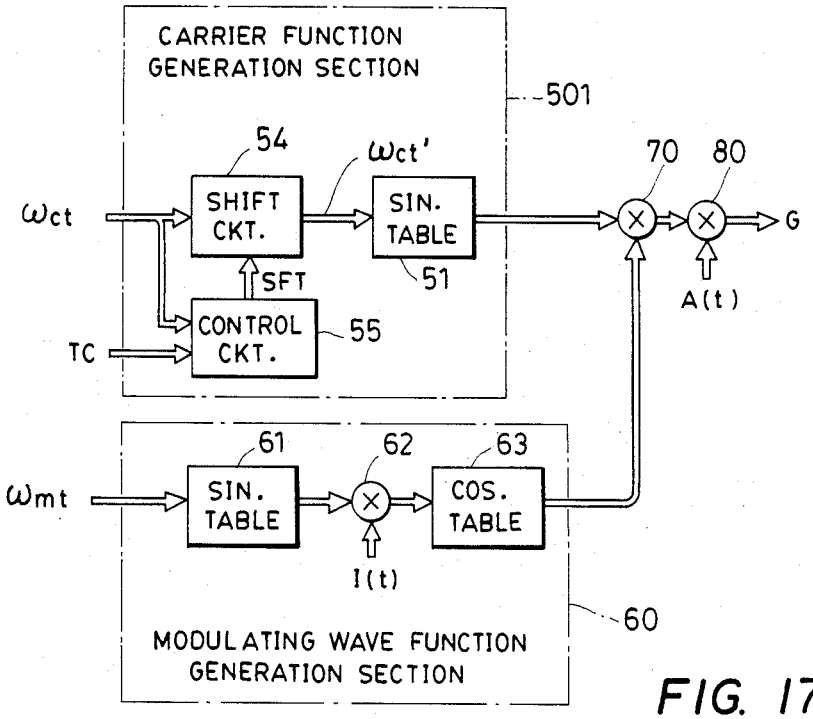
FIG. 17 is a block diagram showing another embodiment of the invention in the tone synthesis system of the AM operation type.

FIG. 17 shows another embodiment of the invention in the AM operation type tone synthesis device. This embodiment comprises, as the one shown in FIG. 10, a modulating wave function generation section 60, multipliers 70 and 80 and a carrier function generation section 501. In this embodiment, the invention is applied to the carrier function generation section 501. The carrier function generation section 501 is composed of a shift circuit 54, a control circuit 55 and a sinusoidal wave table 51. The phase angle data ωct of the carrier is changed by shifting it by a predetermined bit or bits to the more significant bit side or less significant bit side in accordance with the phase shift data SFT produced in the shift circuit 54 in response to the tone color selection signal TC and the phase angle data ωct. This changed phase angle data ωct' is applied as the address signal for the sinusoidal wave table 51.

Thereupon sinusoidal wave data sin ωct' corresponding to the phase angle data ωct' is read out from the sinusoidal wave table 51. In this case, the phase angle data ωct is applied as the address signal to the sinusoidal wave table 51 after being changed in the specified phase section of its one period so that a carrier function of a complicated waveshape similar to the one shown in FIG. 12*d* is produced by the sinusoidal wave table 51. Accordingly, the carrier function itself contains abundant harmonic components in this embodiment also so that a tone signal G which is finally obtained also contains abundant harmonic components.

In the embodiment of FIG. 17 also, if the change in the carrier function is performed by a construction similar to the one shown in FIG. 14, a tone signal with even more abundant harmonic components can be generated. Further, the invention may be applied to the modulating wave function generation section 60 only or both to the carrier function generation section 501 and the modulating wave function generation section 60.

Figure 18:
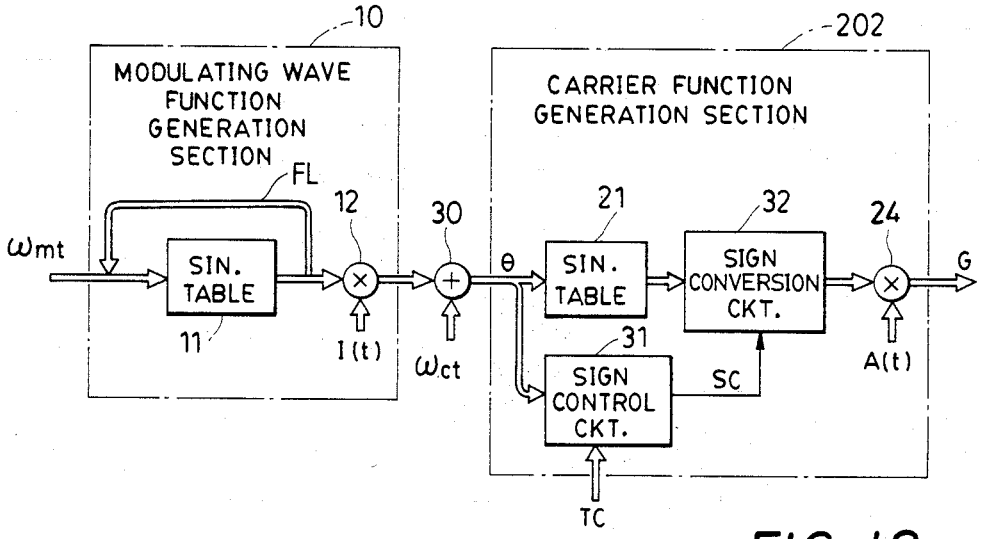
FIG. 18 is a block diagram showing still another embodiment the invention in the tone synthesis system of the AM operation type.

FIG. 18 shows still another embodiment of the invention in the FM operation type tone synthesis device. This embodiment comprises, as the one shown in FIG. 1, a modulating wave function generation section 10, an adder 30 for the phase modulation and a carrier function generation section 202. In this embodiment, the invention is applied to the carrier function generation section 202.

The carrier function generation section 202 is composed of a sinusoidal wave table 2, a sign control circuit 31, a sign conversion circuit 32 and a multiplier 24. Upon application of the phase angle data θ of the carrier from the adder 30 to the sinusoidal wave table 21 as an address signal, sinusoidal wave data sin θ is read out in accordance with the phase angle data θ. In this case, the sinusoidal wave data sin θ has a sign bit and is supplied to the sign conversion circuit 32. In the meanwhile, the phase angle data θ is supplied to the sign control circuit 31. This sign control circuit 31 produces a sign control signal SC which controls the sign of the sinusoidal wave data sin θ read out from the sinusoidal wave table 21 during the specified section of one period of the phase angle data θ. This sign control signal SC becomes "1" when the sign of the sinusoidal wave data sin θ is to be changed whereas it becomes "0" when the sign is not to be changed. The specified section during which the sign control signal SC becomes "1" is changed in accordance with the tone color selection signal TC.

This sign control signal SC is applied to the sign control circuit 31. The sign of the sinusoidal wave data sin θ read out from the sinusoidal wave table 21 is inverted to the reverse sign while the sign control signal SC is "1".

For brevity of explanation, let us assume that the phase angle data θ is data which increases linearly as shown in FIG. 19*a* (θ=ωct). Assuming that the sign control circuit 31 produces a sign control signal SC as shown in FIG. 19*b* in response to the tone color selection signal TC while the phase angle data θ changes from θto 2π, the sign conversion circuit 32 produces sinusoidal wave data which is of an inverted polarity as shown in FIG. 19*c* in the specified phase section of one period of the sinusoidal wave (i.e., while the sign control signal SC is "1"). In other words, if the signal SC becomes "1" at each π of the phase angle data θ, the sinusoidal wave data sin 0 read out from the sinusoidal wave table 21 is inverted in its polarity at each θ and thereby becomes sinusoidal wave data of a positive value only. The waveshape shown in FIG. 19*c* has frequency spectra as shown in FIG. 20. In this manner, the sinusoidal wave data sin θ which has been changed in its polarity in the specified phase section is supplied to the multiplier 24 in which its amplitude is controlled by multiplying the amplitude coefficient data A(t) and thereafter is delivered out as the tone signal G. By way of another example, if the sign control signal SC produced by the sign control circuit 31 in response to the tone color selection signal TC assumes a waveshape as shown in FIG. 19*d*, sinusoidal waveshape data provided by the sign control circuit 31 assumes a waveshape as shown in FIG. 19*e*.

Thus, the tone signal G produced by the carrier function generation section 202 contains abundant harmonic components as will be apparent from the waveshapes shown in FIGS. 19*c* and 19*e*. Consequently, a tone signal G which contains abundant harmonic components can be obtained with a simple construction.

In the same manner as in the above described embodiments, the parameters ωmt, I(t), ωct, TC and A(t) used in this embodiment may also be provided by the circuit as shown in FIG. 4.

In the embodiment of FIG. 18, the change in the polarity of the sinusoidal wave data sin θ produced by the sinusoidal wave table 21 is effected by using the sign conversion circuit 32. Alternatively, the sinusoidal wave data sin θ generated by the sinusoidal wave table 21 may be a signal of an absolute value including no sign and the sign control signal 31 may provide directly a bit signal representing a positive or negative sign. This alternative arrangement will obviate the provision of the sign conversion circuit 32. In this case, a half period of the sinusoidal waveshape may be stored in the sinusoidal wave table 21.

In the above described embodiment, the invention is applied to the carrier function generation section 202. The invention may be applied also to the modulating wave function section 10. More specifically, in FIG. 18, the sign conversion circuit 32 is provided on the output side of the sinusoidal wave table 11 and the phase angle data 8 applied to the sign control circuit 31 is substituted by the phase angle data ωmt of the modulating wave. In this case, the invention may be applied both to the modulating wave function generation section 10 and the carrier function generation section 202. Further, if in FIG. 18 the output waveshape data of the sinusoidal wave table 11 is fed back to the input side as shown by the line FL and the phase angle data ωmt is modulated by this output waveshape data, a tone signal G with even more complicated harmonic components can be obtained.

FIG. 21 shows still another embodiment of the invention in the AM operation type tone synthesis device. This embodiment comprises, as the one shown in FIG. 10, a modulating wave function generation section 60, multipliers 70 and 80 and a carrier function generation section 502. In this embodiment, the invention is applied to the carrier function generation section 502. The carrier function generation section 502 is composed of a sinusoidal wave table 51, a sign control circuit 56 and a sign conversion circuit 57. Upon application of the phase angle data $\omega ct$ of the carrier to the sinusoidal wave table 51 as an address signal, sinusoidal wave data sin $\omega ct$ corresponding to this phase angle data $\omega ct$ is read out from the sinusoidal wave table 51 and supplied to the sign conversion circuit 57. In the meanwhile, the phase angle data $\omega ct$ is supplied to the sign control circuit 56 together with the tone color selection signal TC. The sign control circuit 56 thereby produces a sign control signal SC which becomes "1" only during the specified phase section corresponding to the tone color selection signal TC in one period of the phase angle data $\omega ct$ and supplies this control signal SC to the sign conversion circuit 53. As a result, the polarity of data of the specified phase section in the sinusoidal wave data sin $\omega ct$ read out from the sinusoidal wave table 51 as the carrier function is inverted so that a carrier function of a waveshape similar to the one shown in FIGS. 19*c* and 19*e* is produced. Accordingly, the carrier function itself contains abundant harmonic components in this embodiment also so that a tone signal G which is finally obtained also contains abundant harmonic components.

In this embodiment also, the sign conversion circuit 57 may be omitted and the change in the polarity of the carrier function may be effected by adding a sign bit provided by the sign control circuit 56 to sinusoidal wave data of an absolute value only which is read out from the sinusoidal wave table 51. Further, the invention may be applied to the modulating wave function generation section 60 only or to both the carrier function generation section 502 and the modulating wave function generation section 60.

The conditions of generation of the sign control signal SC generated by the sign control circuits 31 and 56 in FIGS. 18 and 21 may be sequentially changed as time elapses from the start of sounding of the tone.

Figure 22:
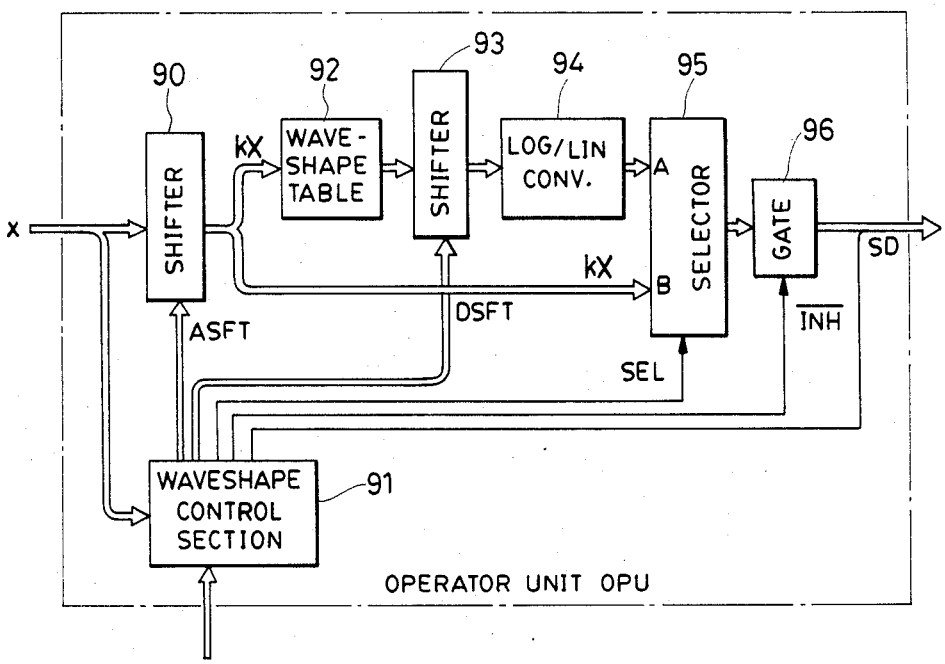
FIG. 22 is a block diagram showing an embodiment of an operator unit for generating a modulating wave and/or carrier wave composed by combining various waveshape changing functions of the invention.

FIG. 22 shows an embodiment of an operator unit OPU which is constructed by combining the various waveshape changing functions as described above. This operator unit OPU can be employed as a carrier function generator and/or a modulating wave function generator in the FM operation type or AM operation type tone synthesis device. By employing this operator unit, a tone signal with an even more complicated waveshape can be produced.

More specifically, by applying phase angle data x to a shifter 90 and shifting the phase angle data x to the more significant bit side or less significant bit side by a shift amount designated by phase shift data ASFT provided by a waveshape control section 91, phase angle data kx whose one period has been multiplied by k is obtained ($k=2^{\pm j}$ where j represents the shift amount j, +j representing a shift to the more significant bit side and −j a shift to the less significant bit side, and ±j being designated by the data ASFT). Then this phase angle data kx is applied as the address signal to a waveshape table 92 which stores sin sinusoidal wave data in a logarithmic value log sin x so that sinusoidal wave data log sin kx is read out from this waveshape table 92. This sinusoidal wave data log sin kx is applied to a shifter 93 where it is shifted to the more significant bit side or less significant bit side by a shift amount designated by waveshape shift data DSFT provided by the waveshape control section 91 to be converted to waveshape data m.log sin kx (m 32 $2^{\pm i}$ where +i represents a shift to the more significant bit side and −i a shift to the less significant bit side and this ±i is designated by the data DSFT), This data m·log sin kx is then applied to a logarithm-linear converter 94 to convert the data to waveshape data $\sin^m kx$ in the linear form. If, for example, the shift amount ±i is i=1 (i.e., the output of the waveshape table 92 is shifted by one bit either to the more significant bit side or less significant bit side), waveshape data $\sin^2 kx$ or $\sqrt{\sin kx}$ is obtained.

This waveshape data $\sin^m kx$ then is applied to a gate 96 through a selector 95 and is outputted only in the specified phase section in which the control signal $\overline{INH}$ provided by the waveshape control section 91 is "1". Further, this waveshape data $\sin^m kx$ in the specified phase section is imparted with the sign data SD of a positive or negative polarity provided by the waveshape control section 91 and thereafter is delivered out.

The phase shift data ASFT, the waveshape shift data DSFT, the select control signal SEL of the selector 95, the control signal $\overline{INH}$ and the sign data SD are so controlled that they differ depending upon the tone color selection signal TC. In a specific selected tone color, phase angle data kx produced by the shifter 90 is selected by the selector 95 and delivered out through a gate 96.

Figure 23A:
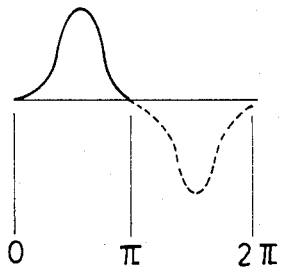
FIGS. 23*a*–23*g* are diagrams showing some examples of various function waveshapes obtainable from the operator unit of FIG. 22.

If, accordingly, the waveshape shift amount ±i designated by the data DSFT is +1, the phase shift amount ±j designated by the data ASFT is 0, the phase section in which the control signal $\overline{INH}$ becomes "0" is $\pi-2\pi$ and the selector 95 is set to an A-input selection state (i.e., the output of the logarithmic-linear converter 95 is selectibly produced) and the sign data SD is positive in the phase section $0-\pi$, waveshape data $\sin x^2$ as shown in FIG. 23*a* is produced only in the phase section $0-\pi$.

Figure 23B:
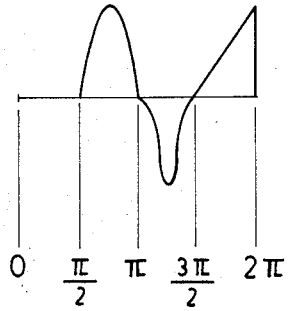

Further, by setting the data ASFT etc. provided by the waveshape control section 91 as shown in Table 1 below, waveshape data as shown in FIG. 23*b* can be obtained.

TABLE 1

| control data | phase $0 \sim \pi/2$ | $\pi/2 \sim \pi$ | $\pi \sim 3\pi/2$ | $3\pi/2 \sim 2\pi$ |
|---|---|---|---|---|
| ASFT | — | j = +1 | j = +1 | j = +2 |
| DSFT | — | i = 0 | i = +1 | — |
| SEL | — | select A | select A | select B |
| $\overline{INH}$ | "0" | "1" | "1" | "1" |
| SD | — | positive | negative | positive |

Further, by setting the data ASFT etc. provided by the waveshape control section 91 as shown in Tables 2 to 6 below, waveshape data of waveshapes as shown in FIGS. 23*c*–23*g* are produced.

TABLE 2

Figure 23C:
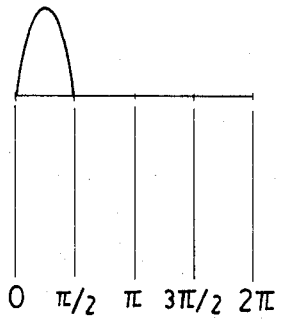
Figure 23D:
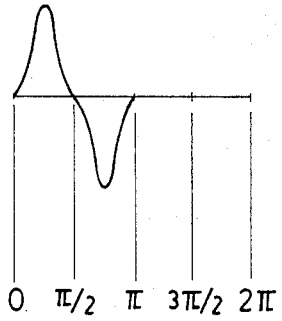
Figure 23E:
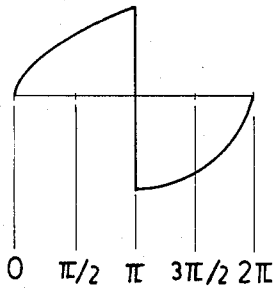
Figure 23F:
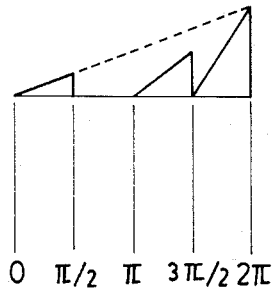
Figure 23G:
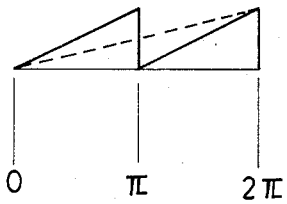

(FIG. 23c)

| control data | phase $0 \sim \pi/2$ | $\pi/2 \sim \pi$ | $\pi \sim 3\pi/2$ | $3\pi/2 \sim 2\pi$ |
|---|---|---|---|---|
| ASFT | j = +1 | — | — | — |
| DSFT | i = 0 | — | — | — |
| SEL | select A | — | — | — |
| $\overline{INH}$ | "1" | "0" | "0" | "0" |
| SD | positive | — | — | — |

TABLE 3

| control data | (FIG. 23d) phase 0 ~ π/2 | π/2 ~ π | π ~ 3π/2 | 3π/2 ~ 2π |
|---|---|---|---|---|
| ASFT | j = +1 | j = +1 | — | — |
| DSFT | i = +1 | i = +1 | — | — |
| SEL | select A | select A | — | — |
| $\overline{\text{INH}}$ | "1" | "1" | "0" | "0" |
| SD | positive | negative | — | — |

TABLE 4

| control data | (FIG. 23e) phase 0 ~ π/2 | π/2 ~ π | π ~ 3π/2 | 3π/2 ~ 2π |
|---|---|---|---|---|
| ASFT | j = −1 | j = −1 | j = −1 | j = −1 |
| DSFT | i = 0 | i = 0 | i = 0 | i = 0 |
| SEL | select A | select A | select A | select A |
| $\overline{\text{INH}}$ | "1" | "1" | "1" | "1" |
| SD | positive | positive | negative | negative |

TABLE 5

| control data | (FIG. 23f) phase 0 ~ π/2 | π/2 ~ π | π ~ 3π/2 | 3π/2 ~ 2π |
|---|---|---|---|---|
| ASFT | j = 0 | — | j = +1 | j = +2 |
| DSFT | — | — | — | — |
| SEL | select B | — | select B | select B |
| $\overline{\text{INF}}$ | "1" | "0" | "1" | "1" |
| SD | positive | positive | positive | positive |

TABLE 6

| control data | (FIG. 23g) phase 0 ~ π/2 | π/2 ~ π | π ~ 3π/2 | 3π/2 ~ 2π |
|---|---|---|---|---|
| ASFT | j = +1 | j = +1 | j = +1 | j = +1 |
| DSFT | — | — | — | — |
| SEL | select B | select B | select B | select B |
| $\overline{\text{INH}}$ | "1" | "1" | "1" | "1" |
| SD | positive | positive | positive | positive |

Accordingly, by generating a carrier function and/or modulating wave function by employing such operator unit OPU, a modulating wave function, carrier function and tone signal with even more complicated waveshape can be generated. Since the carrier function and/or modulating wave function can be selectively generated in this case by only changing the phase angle data x applied to the operator unit OPU, the carrier function and modulating wave function can be readily generated by a common circuit by utilizing this operator unit OPU on a time shared basis whereby the construction of the device can be simplified and the cost of manufacture can be reduced.

For generating the modulating wave function and the carrier function, exclusive waveshape tables for the respective functions may be employed or, alternatively, a single waveshape table may be used for generating the respective functions on a time shared basis. In the waveshape table, not only waveshape data of a sinusoidal wave but waveshape data of a cosine wave, a triangular wave, a rectangular wave or other complicated waveshape may be stored. The modulation operation is not limited to the digital operation but it may be performed by the analog operation.

As will be apparent from the foregoing description, according to the invention, a waveshape of a modulating wave and/or carrier wave previously stored in the waveshape table is converted to a waveshape containing more abundant harmonic components with a very simple construction and the modulation operation is performed by using this converted waveshape, so that a tone signal containing abundant harmonic components can be synthesized with a simple modulation operation system. This enables a compact circuit design and reduction of costs and further synthesis of tone signals of various tone colors by a simple control.

We claim:

1. In a method for synthesizing a musical tone signal on the basis of a predetermined modulation operation employing a modulating signal and a carrier signal, wherein a predetermined waveshape signal is generated in accordance with a stored waveshape table and is used for defining at least one of a modulating wave function and a carrier wave function, wherein the predetermined waveshape signal is a periodic signal having a regularly progressing form within each period, the steps comprising:

specifying a phase section of each period of the waveshape signal, said phase section including plural table values and being less than one period of the waveshape signal;

modifying the waveshape signal in the specified phase section to provide a modified waveshape signal which has a different form in the specified phase section than that of the remainder of the waveshape signal; and executing said modulation operation by utilizing the modified waveshape signal as said modulating signal or said carrier signal.

2. A method as defined in claim 1 wherein said waveshape signal is generated in response to addressing of the stored waveshape table by phase angle data and wherein said modifying is effected by prohibiting, in said specified phase section, supply of said phase angle data thereby to prevent reading out said waveshape signal.

3. A method as defined in claim 1 wherein said modifying is effected by prohibiting, in said specified phase section, delivering out of said waveshape signal generated from said waveshape table.

4. A method as defined in claim 1 wherein said modifying is effected by replacing said waveshape signal generated from said waveshape table during said specified phase section with a signal having a predetermined value.

5. A method as defined in claim 1 wherein said modifying is effected by multiplying, in said specified phase section, said waveshape signal by a predetermined coefficient to obtain the modified waveshape signal.

6. A method as defined in claim 1 wherein said waveshape signal is generated in response to the addressing of the stored waveshape table by means of phase angle data and wherein said modifying is effected by modifying, in said specified phase section, the value of the phase angle data which addresses said waveshape table.

7. A method as defined in claim 6 wherein said modifying is effected by changing, in said specified phase section, the value of said phase angle data to a predetermined constant value.

8. A method as defined in claim 6 wherein the phase angle data is comprises of a plurality of data bits and wherein said modifying of the phase angle data is effected by prohibiting, in said specified phase section, a predetermined bit or bits in said plurality of data bits.

9. A method as defined in claim 6 wherein the phase angle data is comprised of a plurality of data bits and wherein said modifying of the phase angle data is effected by shifting, in said specified phase section, said phase angle data in the direction of a more significant bit or less significant bit by a predetermined number of bits.

10. A method as defined in claim 1 wherein said modifying is effected by inverting the polarity of said waveshape signal generated from said waveshape table in said specified phase section.

11. A method as defined in claim 1 wherein said specified phase section is determined in correspondence to a tone color of a musical tone signal to be synthesized.

12. A method as defined in claim 1 wherein said predetermined modulation operation is a frequency modulation operation.

13. A method as defined in claim 1 wherein said predetermined modulation operation is an amplitude modulation operation.

14. An apparatus for synthesizing a musical tone comprising:

means for supplying modulation data representing a progressive phase angle value of a modulating signal;

means for supplying carrier data representing a progressive phase angle value of a carrier signal; and modulation operation means for executing a predetermined modulation operation employing said modulation data and said carrier data to synthesize a musical tone;

said modulation operation means comprising a modulating wave function generation means generating said modulating signal in response to said modulation data and a carrier function generation means generating said carrier signal in response to said carrier data, wherein said modulation operation means modulates the carrier signal in response to the modulating signal, at least one of said modulating wave function generation means and said carrier function generation means comprising a waveshape table storing predetermined waveshape data, said waveshape data being read out as a waveshape signal from said waveshape table in response to said data representing a progressive phase angle value, wherein said waveshape signal is a periodic signal having a regularly progressing form within each period, means for specifying a phase section of each period of the waveshape signal, said phase section including plural table values and being less than one period of the waveshape signal, and modifying means for modifying, in the specified phase section, the waveshape signal to provide a modified waveshape signal having a form in the specified phase section different from the form of the remainder thereof.

15. An apparatus as defined in claim 14 wherein said modifying means comprises detection means for detecting said specified phase section in responses to a value of said phase angle data to be applied to said waveshape table and means for modifying, upon detection of said specified phase section, the value of the waveshape signal provided by said waveshape table.

16. An apparatus as defined in claim 14 wherein said modulating wave function generation means comprises feedback means for modulating the value of said modulation data applied to said modulating wave function generation means by said modulating signal produced by said modulation wave function generation means.

17. An apparatus as defined in claim 14 wherein said waveshape table and said modifying means are used on a time shared basis for said modulating wave function generation means and said carrier function generation means.

18. An apparatus for synthesizing a musical tone comprising:

means for supplying modulation data representing a progressive phase angle value of a modulating signal;

means for supplying carrier data representing a progressive phase angle value of a carrier signal; and modulation operation means for executing a predetermined modulation operation employing said modulation data and said carrier data to synthesize a musical tone;

said modulation operation means comprising a modulating wave function generation means generating said modulating signal in response to said modulation data and a carrier function generation means generating said carrier signal in response to said carrier data, wherein said modulation operation means modulates the carrier signal in response to the modulating signal, at least one of said modulating wave function generation means and said carrier function generation means comprising a waveshape table storing predetermined waveshape data, said waveshape data being read out as a waveshape signal from said waveshape table in response to the data representing a progressive phase angle value, wherein said waveshape signal is a periodic signal having a regularly progressing form within each period, means for specifying a phase section of each period of the waveshape signal, and modifying means for modifying, in a specified phase section, the waveshape signal to have a form different from the regularly progressing form, wherein said modifying means comprises detection means for detecting said specified phase section in response to a value of said data representing said progressive phase angle value to be applied to said waveshape table and means for modifying, upon detection of said specified phase section, the value of said data representing said progressive phase angle value to be applied to said waveshape table.

19. An apparatus for synthesizing a musical tone comprising:

means for supplying modulation data representing a progressive phase angle value of a modulating signal;

means for supplying carrier data representing a progressive phase angle value of a carrier signal; and modulating operation means for executing a predetermined modulation operation employing said modulation data and said carrier data to synthesize a musical tone;

said modulation operation means comprising a modulating wave function generation means generating said modulating signal in response to said modulation data and a carrier function generation means generating said carrier signal in response to said carrier data, wherein said modulation operation means modulates the carrier signal in response to the modulating signal, at least one of said modulating wave function generation means and said carrier function generation means comprising a waveshape table storing predetermined waveshape data, said waveshape data being read out from said waveshape table in response to said data representing a progressive phase angle value, and modifying means for modifying, in a specified phase section, a value of waveshape data read out from said waveshape table, wherein said modifying means comprises:

a first circuit for modifying the value of said data representing a progressive phase angle value applied to said waveshape table in response to a first control signal;

a second circuit for modifying the value of said waveshape data provided by said waveshape table in response to a second control signal;

a third circuit provided for setting the polarity of said waveshape data in response to a third control signal; and control means for detecting one or more predetermined phase sections in accordance with the value of said data representing a progressive phase angle value before being applied to said first circuit and selectively generating, upon this detection, said first to third control signals in a predetermined combination.

20. An apparatus as defined in claim 19 wherein the combination and phase section of said control signals generated by said control means are determined in accordance with the tone color of the tone signal to be synthesized.

21. An apparatus as defined in claim 19 wherein said second control signal includes a shift control signal and a prohibition control signal and said second circuit comprises a shift circuit for shifting the value of said waveshape data provided by said waveshape table in response to said shift control signal and a prohibition circuit for prohibiting the waveshape data provided by said waveshape table in response to said prohibition control signal, said shift circuit and said prohibition circuit being connected in series to each other and said control means generating said shift control signal and said prohibition control signal in different phase sections.

* * * * *